United States Patent [19]

Gegenhuber

[11] 4,220,267

[45] Sep. 2, 1980

[54] CLOSURE ASSEMBLIES

[75] Inventor: Peter Gegenhuber, Randburg, South Africa

[73] Assignee: Michael J. Harris, Bedfordview, South Africa

[21] Appl. No.: 10,044

[22] Filed: Feb. 6, 1979

[30] Foreign Application Priority Data

Oct. 18, 1976 [ZA] South Africa ..... 76/6195
Feb. 9, 1978 [ZA] South Africa ..... 78/0778

[51] Int. Cl.[2] ..... B65D 35/48
[52] U.S. Cl. ..... 222/520
[58] Field of Search ..... 222/549, 498, 499, 520

[56] References Cited

U.S. PATENT DOCUMENTS 1,152,817 9/1915 Hyatt ..... 222/520
2,533,915 12/1950 Brooks ..... 222/520 X
3,199,749 8/1965 Driscoll ..... 222/520

*Primary Examiner*—Stanley H. Tollberg
*Attorney, Agent, or Firm*—Cushman, Darby & Cushman

[57] ABSTRACT

A hollow tubular outlet member and a cap fitting over the outlet member and rotatable relative thereto, the outlet member and cap having complementary conical end portions, an aperture in each conical end portion which can be aligned to define an opening which can be closed by rotation of the cap and wherein the cap and outlet have a co-axial tubular portion, one of such tubular portions being provided with at least one formation directed towards the other tubular portion and co-operating with a cam surface on the other tubular portion, the cam surface being shaped such that the conical end portions are urged axially into tighter engagement with each other during rotation of the cap to close the opening.

15 Claims, 16 Drawing Figures

Fig 12.
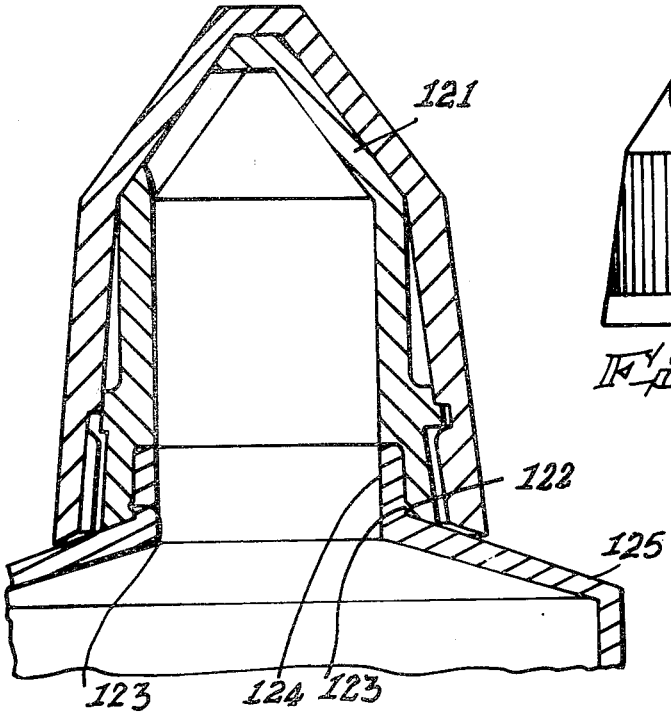
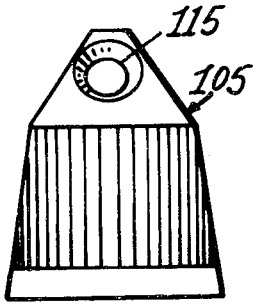
Fig 13.
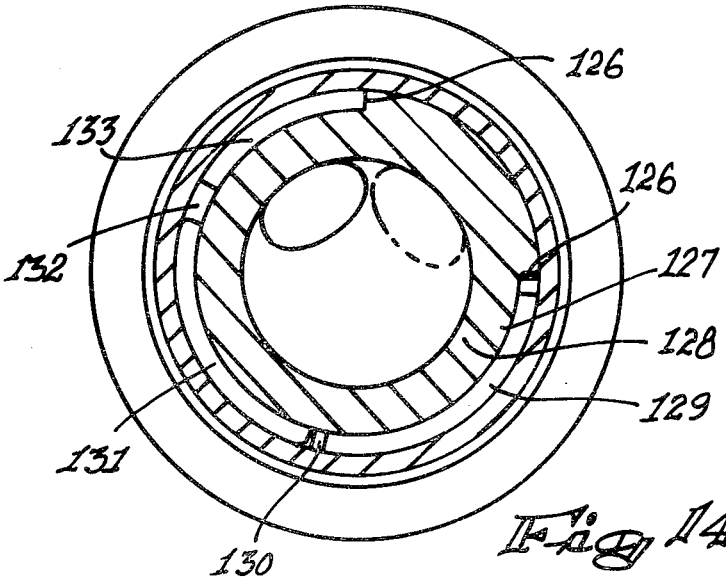
Fig 14.

CLOSURE ASSEMBLIES

This invention relates to closures which may be used for releasably closing off any type of outlet as required.

Of particular interest is a closure for a container and of still more particular interest are closures for flexible tubes such as toothpaste, shampoo and cosmetic containing tubes. However, the invention is in no way confined in application to such closures and includes within its scope, closures such as those used for bleeding air out of liquid containing systems; dispensing containers for pharmaceutical products in either liquid or unit dosage form; and adjustible water jets on garden sprinklers or garden hoses.

SUMMARY OF THE INVENTION

It is the object of this invention to provide a closure which, has a sufficiently large aperture for allowing passage of a substance therethrough, provides an effective seal in the closed condition thereof, and wherein the closure member itself is permanently associated with the outlet with which it co-operates and is moved from an open to a closed position by a simple rotational movement.

In accordance with one aspect of this invention, there is provided a closure assembly, comprising:

a hollow tubular outlet member; and a cap fitting over the outlet member and being rotatable relative thereto;

said outlet member and said cap having wall means defining complementary conical end portions;

means defining an aperture in each said conical end portion which apertures can be aligned by rotation of the cap relative to the outlet member to define an opening and which can be offset by rotation of the cap relative to the outlet member to close said opening;

the cap and outlet each having wall means defining a co-axial tubular portion;

one of such tubular portions being provided with at least one formation directed towards the other such tubular portion;

one of such tubular portions being provided with at least one formation directed towards the other such tubular portion;

said other such tubular portion being provided with a cam surface co-operating with said at least one formation;

said cam being shaped such that said conical end portions remain substantially axially stationary relative to each other during initial rotation of the cap from when said apertures are aligned and define said opening, in a sense to offset and thus close the opening, but once the opening is closed, further offsetting rotation of the cap causes said conical end portions to be urged axially into tighter engagement with each other; and said cam surface further being shaped to provide a click stop for when said apertures are fully offset and said conical end portions are urged axially into said tighter engagement.

Further features of the invention provide for the tubular outlet to be integral with at least a shoulder portion of a container or for the outlet to be provided with a spigot or socket to enable it to be connected to a complementary socket or spigot.

Still further features of the invention provide for both the cap and outlet to be manufactured from injection moulded plastics material and for the cap to be a snap-fit onto the outlet for assembly purposes.

The invention also provides a closure assembly comprising a hollow tubular outlet member and a cap fitting over the outlet member and rotatable relative thereto the outlet member and cap having complimentary substantially conical end portions substantially in engagement with each other, an aperture in each conical end portion which can be selectively aligned or non-aligned by relative rotation of the cap and outlet member and wherein the cap has a tubular portion adjoining with the conical end portion and located over the hollow tubular outlet member so as to be co-axial therewith, one of such tubular portions having at least one formation directed towards the other tubular portion and co-operating with a cam surface on said other tubular portion where-in said cam surface is shaped such that the conical or truncated conical end portions are urged axially into tighter engagement with each other during at least a part of the allowed rotation of the cap in a direction away from that in which the apertures are aligned, the closure assembly being characterized in that the tubular portion having the cam surface therein is provided with one axially extending channel shaped to receive each formation carried by the other tubular portion such that each channel receives said formation when the cap is moved axially onto the outlet and wherein the cam surface communicates with each channel through a zone adjacent the channel such that after introduction of each formation fully into a channel formation to align with the cam surface, rotation of the cap relative to the outlet forces the formations into co-operation with the cam surface by way of said zone which is formed to act as a catch to inhibit movement of a formation past said zone.

Further features of this aspect of the invention provide for the cam surface to be defined by one side wall of a channel shaped formation extending circumferentially about said other tubular portion, for there to be either one formation and channel or two symmetrically disposed formations and co-operating channels, for the conical end of the outlet to be truncated so as to provide at least a space between its ultimate end surface and the inner end surface of the cap, for the tubular outlet to be of constant diameter along its length and to carry at a position removed from the conical end the formations defined above, and for the tubular portion of the cap to be of a truncated concial shape wherein the cone angle is substantially smaller than the cone angle of the end portion.

The above and other features of the invention will become more apparent from the following description of one embodiment thereof. In this description reference will be made to the accompanying drawings in which:

FIG. 12 is a view similar to FIG. 9 but showing an alternative way of connecting an outlet member to a container mouth;

FIG. 13 is an elevation of a cap above, and

FIG. 14 is a view similar to FIG. 10 but illustrating the invention where only one formation and channel are provided;

Figure 1:
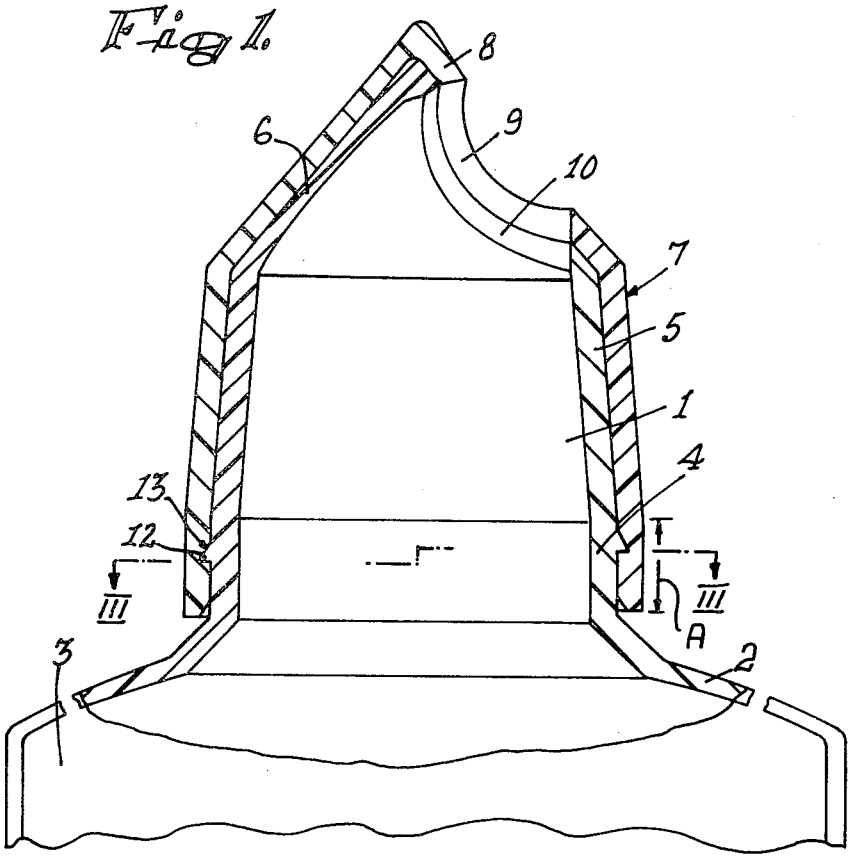
FIG. 1 is a sectional elevation of a closure assembly.

In the embodiment of the invention illustrated in FIGS. 1 to 4 the invention is applied to a closure for a flexible cosmetics tube, such as a toothpaste tube. In this application of the invention a tubular outlet 1 is formed integral with a shoulder portion 2 of a tube 3 with which the shoulder portion may be integral if required. The tubular outlet is formed in three sections whereof a section 4 adjacent the shoulder is of constant circular cross-section; a second section 5 more removed from the shoulder tapers slightly inwardly whilst being of circular cross-section, and a third section 6 defines and end to the outlet and is of conical shape.

A cap 7 of complementary shape to the outlet fits over the latter and is formed such that the adjacent surfaces of the outlet and cap are substantially in contact throughout their area. Since the conical end portions serve to centre the cap on the outlet, it is not essential that the slightly tapered section 4 and cylindrical end portion 3 be tightly in contact with the adjacent cap surfaces and a small space can, in fact, be provided. The conical portions 8 and 6 of the cap and outlet respectively are each provided with apertures 9 and 10 respectively in the walls of the conical portions. The cone angle is selected so that an aperture of reasonable diameter can be provided relative to the diameter of the tubular outlet. These two diameters can, in many instances, be of comparable size. A preferred cone angle is thus about 80°.

In order to facilitate injection moulding from plastics material, the lower region 11 of each aperture has its edge substantially parallel to the axis of the outlet to allow for withdrawal of a male mould member from the moulded article located in a female mould member. At least in the case of the cap this provides an aperture which increases in diameter from the outer surface to the inner surface thereof, thereby providing an inclined edge to the aperture. In use, this inclined edge has the effect of wiping material back into the outlet during closure of the cap.

The apertures and adjacent inner surface of the conical portion 6 of the outlet are shaped substantially smoothly to provide an outlet passage which will not interfere to any appreciable extent with the dispensing of, for example, toothpastes having stripes of mouthwash or the like therein.

The portion 4 of the outlet of constant circular cross-section has on the outer surface thereof a pair of diametrically outwardly extending formations 12 which extend into grooves 13 defining cam surfaces in the inner surface of the cap. It will be understood that the operative cam surface is provided by the lower sidewall 14 of the groove since the sidewall co-operates with the formations 12.

Figure 2:
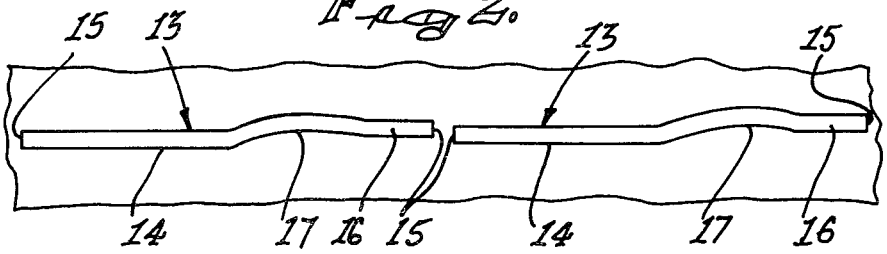
FIG. 2 is a development of the portion indicated by arrow "A" in FIG. 1 of the cap illustrating the shape of the cam grooves.
Figure 3:
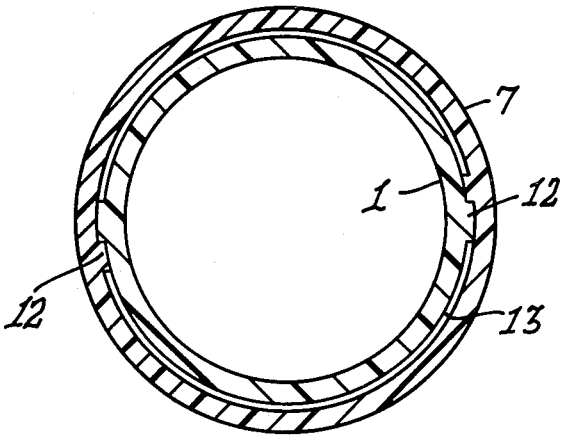
FIG. 3 is a cross-section taken along line III—III in FIG. 1.
Figure 4:
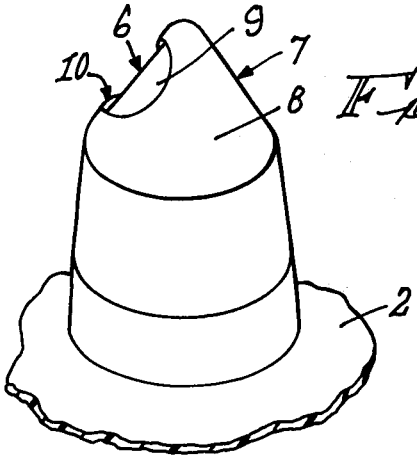
FIG. 4 is an isometric view of the closure assembly in a closed condition.

There are two identical grooves 13 as shown clearly in FIG. 2 and each is adapted to co-operate with its associated formation in an identical manner. The grooves provide for approximately 170° of rotation of the cap relative to the outlet and the ends 15 of the grooves define stops limiting further rotation of the cap. The grooves extend circumferentially for approximately a 90° angle which corresponds to the various degrees of correspondence of the apertures in the cap and outlet. The grooves then become somewhat upwardly inclined and again downwardly inclined in the axial direction relative to the apertures to terminated in end portions 16 of the grooves. The end portions correspond to the locked closed position. The end portions are further located so that they are axially displaced from the major portion of the length of the grooves in a manner ensuring that a slight axial movement of the cap into tighter engagement with the outlet is promoted when cap is rotated to a locked position. This axial movement may be very small and, in fact, it is envisaged that with fairly accurately moulded components, an axial movement of approximately 0.1 to 0.2 mm is all that will be required. The inclined portions provide a raised region 17 of the groove which ensures that the cap cannot rotate out of the locked closed position without overriding this raised portion. The latter structure provides what is commonly termed a "click" stop in the closed portion of the cap.

It will be understood that rotation of the cap between a closed and open position can easily be effected using the thumb of a hand used to hold an article carrying such a closure. To this end the cap may be provided with any type of formation or friction affording surface to ensure that this can be effected easily.

Figure 5:
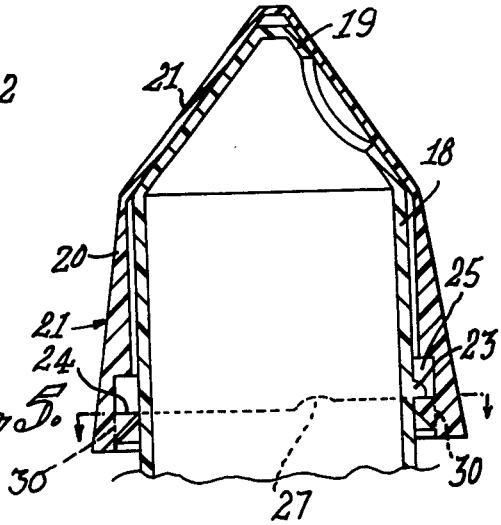
FIGS. 5, 6 & 7 are views similar to FIGS. 1, 2 and 3 but of a modified form of the embodiment illustrated therein.
Figure 6:
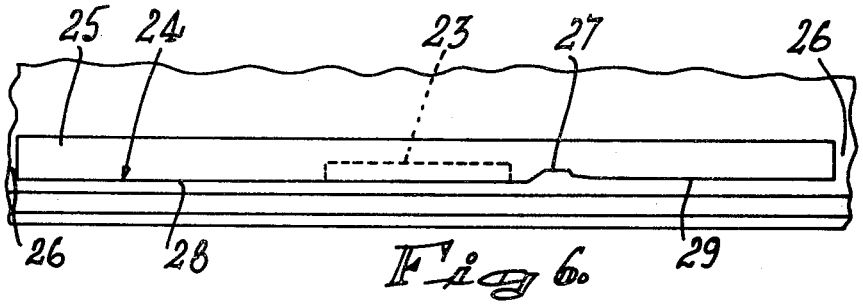
Figure 7:
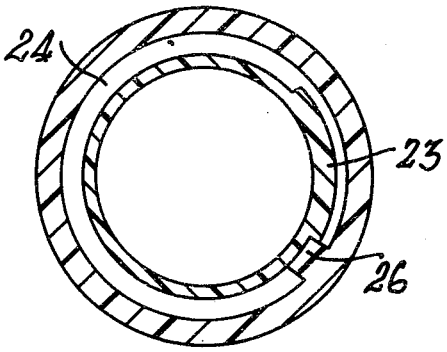

A slightly modified form of the invention is illustrated in FIGS. 5 to 7. In this instance the tubular outlet 18 is of substantially constant diameter up to the position where it joins up with the conical portion 19. The cap 20 is dimensioned to be a fractionally loose fit on the outlet and has a conical outer surface 21 to provide a thickened region in the wall remote from the conical portion 22 of the cap.

The outlet in this case has a single outwardly directed formation 23 in the form of a flange extending circumferentially around the outer in an arc of about 60° to 80°. This single formation co-operates with an annular cam surface 24 directed towards the conical end portions and defining one wall to a groove 25 in the inner surface of the cap towards its lower end. The groove extends around substantially the entire circumference of the cap but for a short portion 26 which defines a stop to prevent the cap from being rotated by more than about 275°.

The cam surface has a single raised portion 27 joining a large portion 28 of the cam surface and a smaller portion 29 thereof. The smaller portion 29 is, as above described, in respect of each half of the groove 13, somewhat nearer the conical end portion than the larger portion 28. This provides the slight clamping action of the cap upon closure thereof and will not be further described.

The cam surface 24 in this case could be provided on a separate ring which fits into the cap to provide a join as indicated by dotted lines 30 in FIG. 5. These two parts would be bonded together at this join upon assembly of the closure. The purpose of making such a separate ring would only be to avoid the use of a collapsible female die for forming the groove in the interior of the cap.

In use the closure assembly just described will function in the same way as that described with reference to FIGS. 1 to 4.

As mentioned above the outlet will generally be integral with at least a shoulder portion of a container but it may equally well be integral with a lid for a container other than a tube. Also the outlet could be formed with a socket at its open end so that it can be installed on an existing screw threaded spigot associated with a dispensing tube for example.

Figure 8:
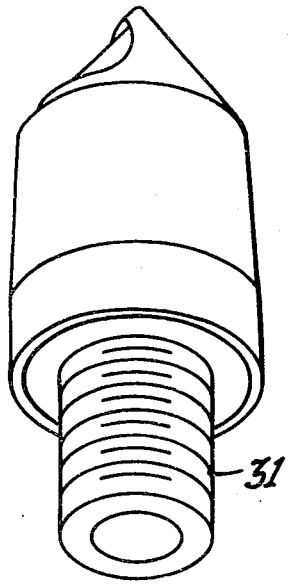
FIG. 8 illustrates in isometric view the application of the invention to a bleeding valve.
Figure 9:
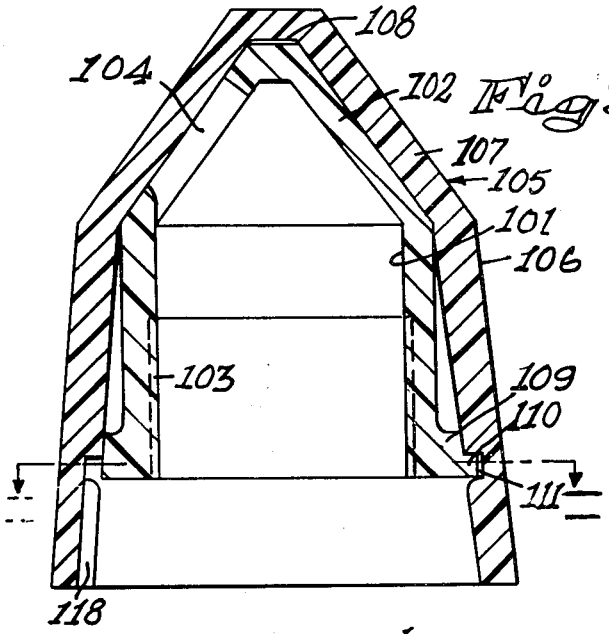
FIG. 9 is a sectional elevation of a cap assembly taken along line IX—IX in FIG. 10.
Figure 10:
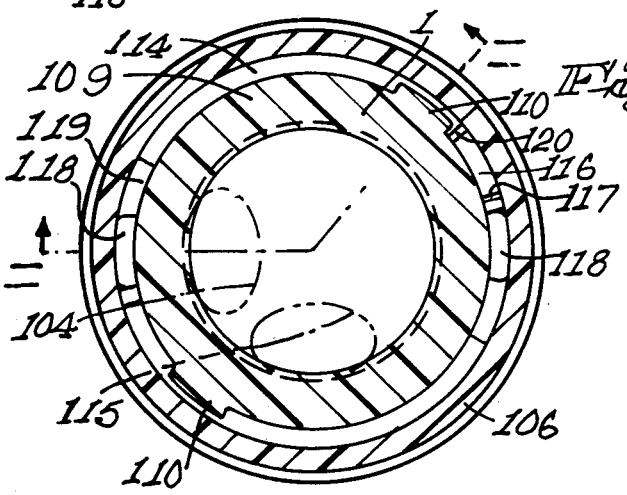
FIG. 10 is a cross-sectional view of the closure assembly taken along line X—X in FIG. 9.

In addition, as shown in FIG. 8, the outlet may be provided with a screw threaded spigot 31 to enable it to be installed in a socket or screw threaded hole in a pipeline as a bleeder valve for gasses contained in liquid streams for example. In such application it will be appreciated that the closure may be made of metal for high pressure used and in such a case an O-ring may be installed around the aperture in the outlet so that the cap seals on to the O-ring in the closed position. Alternatively, an insert made of a suitable material for providing a seal may be included around the aperture. Suitable materials are, for example, plastics or elastomeric materials such as polypropylene, polytetrafluoroethylene or polyurethane.

In the embodiment of the invention illustrated in FIGS. 9 to 11 and 13 the closure assembly is adapted to be screwed onto an existing externally screw threaded outlet to a container such as a toothpaste tube or other container for liquid materials or pastes. However, it will be understood that the outlet could equally well be manufactured as an integral portion of such a container as clearly described in application Ser. No. 843,045 filed Oct. 17, 1977, now abandoned.

In this embodiment the outlet member has a tubular portion 101 of constant diameter and having at its outermost end a truncated conical portion 102 having in this case a cone angle of approximately 70°. The tubular portion 101 has an integral screw-thead 103 adapted to be secured onto a toothpaste or like tube having a complimentarily screw-threaded spigot (not shown). Thus, in this particular instance the internal diameter of the tubular portion of the outlet is about 10.7 mm. This diameter enables an aperture 104 to be formed in the conical end portion wherein the aperture has a diameter of about 6.25 mm.

A co-operating cap 105 has a tubular portion 106 fitting over the tubular portion 101 of the outlet and a complimentary conical end portion 107 co-operating with the conical end portion 102 of the outlet. However, the conical portion 107 of the cap is arranged to provide a small space 108 between the end face of the outlet and the inner adjacent face of the cap thereby allowing for the axial movement of the cap into tighter engagement with the conical surface of the outlet when the cap is rotated into a position in which the outlet assembly is locked in a closed position.

The tubular portion 106 of the cap is also of truncated conical shape but in this case the cone angle is only about 11° in the preferred form. Thus the outer surface of the tubular portion of the outlet diverges from the inner surface of the tubular portion of the cap in a direction away from the conical portions thereof.

The tubular portion of the outlet is provided with an outwardly extending flange 109 at its end remote from the conical portion and the flange 109 carries a pair of oppositely directed, outwardly extending lugs 110, which co-operate with a groove 111 in the inner surface of the cap. The side wall 112 of the groove nearer the conical portion of the cap is simply an annular wall formed in one plane. However the side wall 113 of the groove most remote from the conical portion is formed to define cam surfaces.

This side wall has a portion 114 defining the co-operating wall for the lugs 110 corresponding to various degrees of coincidence of an aperture 115 in the cap (which is of the same diameter as the aperture 104 in the outlet) and the aperture 104 in the outlet member. Adjoining this section 114 of the side wall of the groove is a raised nib 120 which communicates with a raised section 116 of the cam surface. The latter section 116 of the cam surface is adapted to co-operate with the lugs when the apertures in the cap and outlet are in non-coincidence with each other and thus corresponds to a closed and locked condition of the cap wherein the cap is urged more tightly onto the outlet.

At the end of the section 116 of the wall 113 defining the cam surface is a raised stop member 117 which ensures that the width of the groove in this region is somewhat less than the thickness of the lugs 110. This narrowed zone of the groove communicates directly with a channel 118 formed in the inner surface of the cap to extend to its end remote from the conical portion in a generally axial direction. It will be understood that the above described cam surface and channel arrangement is duplicated so that the various sections thereof have diametrically opposed counter-parts on the opposite side of the cap. Also at the end of each section 114 of the wall of the groove remote from the associated nib 120 is an end stop member 119 past which the lugs cannot, in use, proceed.

Figure 11:
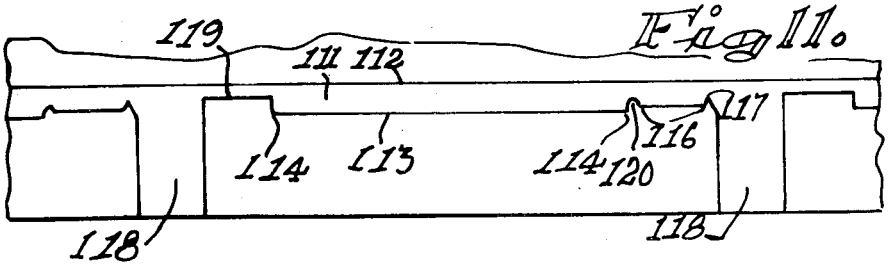
FIG. 11 is a development of the inside surface of the lower portion of the cap of FIGS. 9 and 10 showing the channels and cam surface arrangement.

The stop member formation in the wall of the groove defining the cam surfaces is preferably pointed as shown in FIG. 11 so that a lug introduced up the channel 118 can be forced past the stop formation 117 and into the groove proper. The stop formation thus acts in the manner of a catch. It will thus be appreciated that the dimensions of the channel 118 are chosen such that they comfortably receive the lugs 110 on the outlet member and thus assembly of the closure assembly is greatly facilitated since the cap can be introduced axially onto the outlet member with the lugs located in the channels and then the cap can simply be rotated to locate the lugs in the grooves having cam surfaces associated therewith. Also by correctly proportioning the depth of the groove and of course the corresponding dimensions of the lugs, the cap portion can be injection moulded in a simple male and female type of injection die assembly and, whilst the material is still fairly plastic the cap can be forced off the male die. Thus a collapsible die assembly may be avoided with its attendant high cost.

In use the closure will, for the purposes of transport, storage and vending, be in a condition in which the lugs 110 co-operate with the raised portions 116 of the cam surface to hold the cap tightly onto the outlet. In this condition accidental rotation of the cap is substantially prevented as the lugs have to snap past the nibs 120 in order to align the apertures 104 and 115. Accidental rotation of the cap in the opposite direction is even more difficult to achieve as the lugs must pass the stops 117.

When desired, the cap can be rotated such that the lugs ride over the nibs 120 to a position in which they co-operate with the section 114 of the side wall 113 defining the cam surface. This section is sufficiently long to enable the cap to be rotated between a fully closed and a fully open position in which the apertures are aligned. With the lugs co-operating with this section of the cam surface the axial force urging the two conical end portions together has been released and the cap can easily be rotated, usually by means of a thumb only, between the open and closed positions without axial movement of the cap relative to the outlet. For travelling purposes the cap can again be rotated such that the lugs pass the nibs 120 and co-operate with the raised portions 116 of the cam surface in which position the cap is urged axially onto the outlet member.

FIG. 12 illustrates an alternative outlet member 121 which, instead of the screw threads therein, has one or more circumferentially extending groove 122 in its inner surface towards the end remote from the conical end portion thereof. These grooves are arranged to co-operate with complementary riges 123 on the outer surface of a spigot end 124 to a container 125.

It will understood that certain restrictions as to the maximum permissible angular rotation of the cap, once installed, relative to the outlet. As a consequence, the size of aperture relative to the overall size of the cap and outlet is also limited. In cases where this limitation is restrictive for the desired purpose the embodiment of the invention illustrated in FIG. 14 of the accompanying drawings can be used.

In the case of the embodiment of FIG. 6, only one lug 126 is provided on the flange 127 carried by the outlet member 128. The circumferential length of the lug can be greater than that of the two lug arrangements described above and yet provide for substantially greater relative rotation of the cap and outlet. In this case only one channel 129 is provided, one stop 130 adjacent the raised portion 131 of the cam surface, and one nib 132 between the latter and the remainder 133 of the cam surface with which the single lug co-operates for normal rotation between open and closed conditions.

It will be clear that whilst the closure assemblies described above are all intended to be moulded from plastics material, metal closures of this type could be desirable for many applications and in particular for the purpose of bleeding liquids or gases from liquid systems such as bleeding air from vehicle hydraulic brake systems.

Figure 15:
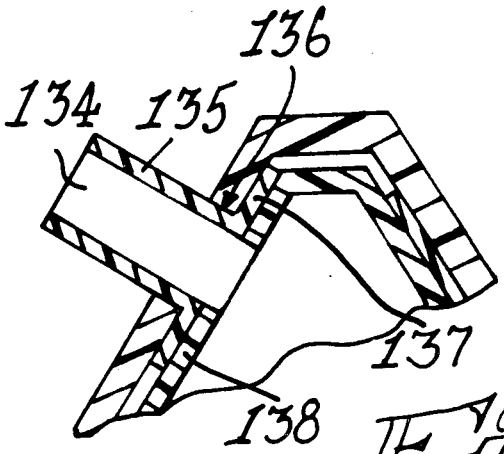
FIG. 15 shows use of an insert for metal closure assemblies.

For the above-mentioned application, to metal closure assemblies, it has been found convenient to provide an insert 134 (see FIG. 15) wherein the insert has a tubular part 135 extending out of the aperture 136 in the cap itself and has a flange 137 located inside the cap and between the inner surface of the cap and the outer surface of the co-operating conical portion 138 of the outlet member. This insert is preferably made of a deformable or elastomeric material such as a suitable plastics material such as those mentioned above and being somewhat compressible and of a material providing a good seal allows for the axial urging of the conical portions together to create an effective seal in the locked position. It will be understood that the flange region 137 of the insert actually defines the seal.

Figure 16:
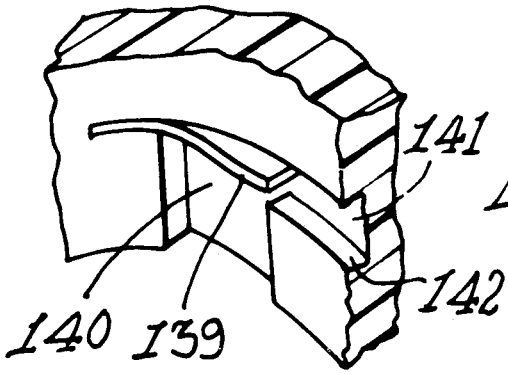
FIG. 16 illustrates use of a spring to prevent lug removal.

Also in the case of a metal cap it will not be possible to provide the restricted zone at the position where the cam surface communicates with the channel where such is provided. In such a case, as illustrated in FIG. 16, a leaf spring 139 could be provided at the inner end of the channel 140 so that its free end obstructs the entrance to the groove 141 defining the cam surface 142. In order to introduce a lug located on a suitable outlet member (not shown) the lug could simply be forced against the leaf spring to deflect it sufficiently away from the entrance to the groove 141 so that the lug can pass into this groove. Once in the groove the spring deflects back to its relaxed condition in which it obstructs the entrance to the groove 141 and thereby prevents removal of a lug simply by rotating the cap relative thereto. It will be understood that other catch arrangements could equally well be provided and these could embody helical springs or any other resilient member performing the general function just described.

It will be understood that many variations may be made to the above described embodiments of the invention without departing from the scope hereof. In particular the lugs or equivalent formations may be provided on the cap and the cam surface and channels on the outlet member. Also, it will be noted that the outlet member could easily be formed integral with certain types of containers.

What we claim as new and desire to secure by Letters Patent is:

1. A closure assembly comprising a hollow tubular outlet member and a cap fitting over the outlet member and rotatable relative thereto the outlet member and cap having complimentary, substantially conical end portions substantially in engagement with each other, an aperture in each conical end portion which can be selectively aligned or non-aligned by relative rotation of the cap and outlet member and wherein the cap has a tubular portion adjoining with the conical end portion and located over the hollow tubular outlet member so as to be co-axial therewith, one of such tubular portions having at least one formation directed towards the other tubular portion and co-operating with a cam surface on said other tubular portion wherein said cam surface is shaped such that the conical or truncated conical end portions are urged axially into tighter engagement with each other during at least a part of the allowed rotation of the cap in a direction away from that in which the apertures are aligned, the closure assembly being characterized in that the tubular portion having the cam surface therein is provided with one axially extending channel shaped to receive each formation carried by the other tubular portion such that each channel receives said formation when the cap is moved axially onto the outlet and wherein the cam surface communicates with each channel through a zone associated with the inner region of the channel such that after introduction of each formation fully into a channel formation to align with the cam surface, rotation of the cap relative to the outlet forces the formations into co-operation with the cam surface by way of said zone which is formed to act as a catch to inhibit movement of a formation past said zone.

2. A closure assembly as claimed in claim 1 in which the tubular outlet is integral with at least a shoulder portion of a container.

3. A closure assembly as claimed in claim 2 in which the shoulder portion is, in turn, integral with a body of the container.

4. A closure assembly as claimed in claim 1 in which the outlet is provided with a spigot or socket for enabling connection thereof to a complementary socket or spigot.

5. A closure assembly as claimed in claim 1 in which the cap and outlet are made from injection moulded plastics material.

6. In combination, a container having an outlet provided with the closure assembly of claim 1 as a closure means for said outlet thereof.

7. A closure assembly as claimed in claim 1 in which the conical end portion to the outlet is truncated to provide a space between the end surface and the inner end surface of the co-operating conical end portion of the cap.

8. A closure assembly as claimed in claim 1 in which there is provided a seal interposed between the inner surface of the cap and outer surface of the outlet member and wherein the seal surrounds the apertures in the open position.

9. A closure assembly as claimed in claim 8 in which the seal has a tubular extension extending out of the aperture in the cap.

10. A closure assembly as claimed in claim 1 in which a resilient catch is provided at the inner end of each channel to define said zone.

11. A closure assembly as claimed in claim 1 wherein the cam surface is shaped to provide a click stop for arresting rotation of the cap relative to the outlet when the apertures are fully offset and said conical end portions are urged axially into tighter engagement.

12. A closure assembly as claimed in claim 1 in which the cam surface is defined by one side wall of a channel shaped formation extending circumferentially about said other tubular portion.

13. A closure assembly as claimed in claim 1 in which there is one formation and co-operating cam surface.

14. A closure assembly as claimed in claim 1 in which there are two symmetrically disposed formations and co-operating cam surfaces.

15. A closure assembly as claimed in claim 1 in which the cam surface is shaped to allow rotation of the cap from a position in which the apertures are aligned to a position in which they are unaligned without any axial urging of the cap into tighter engagement with the outlet and to provide said axial urging only upon further rotation of the cap away from the position in which the apertures are aligned.

* * * * *